US005458554A

United States Patent [19]

Lo

[11] Patent Number: 5,458,554

[45] Date of Patent: Oct. 17, 1995

[54] APPARATUS ENABLING ONE PERSON TO DO ARM-WRESTLING EXERCISE

[76] Inventor: Hsin-Hsin Lo, 9, Alley 3, Lane 35, Weitao Rd., N. Dis. Taichung, Taiwan

[21] Appl. No.: 173,931

[22] Filed: Dec. 28, 1993

Related U.S. Application Data

[63] Continuation of Ser. No. 987,447, Dec. 7, 1992, abandoned.

[51] Int. Cl.[6] ..... A63B 21/02

[52] U.S. Cl. ..... 482/123; 482/905; 482/127

[58] Field of Search ..... 482/123, 129, 482/905, 127

[56] References Cited

U.S. PATENT DOCUMENTS

| | | | |
|---|---|---|---|
| D. 237,634 | 11/1975 | Rickettis | 482/905 |
| 496,094 | 4/1893 | Peloquin | 482/905 |
| 929,281 | 7/1909 | Brodeur | 482/905 |
| 948,140 | 2/1910 | Johnson | 482/905 |
| 3,938,389 | 2/1976 | Kella | 482/905 |
| 4,063,727 | 12/1977 | Hall | 482/123 |
| 4,756,522 | 7/1988 | Sandoval | 482/127 |
| 5,087,038 | 2/1992 | Hao et al. | 482/905 |

FOREIGN PATENT DOCUMENTS

| | | | |
|---|---|---|---|
| 3941071 | 12/1990 | Germany | 482/905 |

*Primary Examiner*—Lynne A. Reichard
*Attorney, Agent, or Firm*—Larson and Taylor

[57] ABSTRACT

An apparatus enabling one person to do the arm-wrestling exercise comprises an animated arm, which is made of an appropriate material and is composed of a plurality of iron bars having an appropriate elasticity. The animated arm is fastened to an arm support mount by means of an elongate iron piece and a screw. The arm support mount is fastened by means of a plurality of small quick screws to a triangular seat which is in turn fastened to a desk top by means of a plurality of large quick screws.

6 Claims, 4 Drawing Sheets

APPARATUS ENABLING ONE PERSON TO DO ARM-WRESTLING EXERCISE

This application is a continuation of application Ser. No. 07/987,447 filed Dec. 7, 1992, now abandoned.

BACKGROUND OF THE INVENTION

The present invention relates to arm-wrestling which is also known as known as Indian wrestling.

The arm-wrestling is a competitive sport in which two persons grasp each other's hand,with their elbows resting on a flat surface, and in which the winner is the one who forces the other's arm down to the surface.

Needless to say, it is impossible for one person to do the exercise of arm-wrestling.

SUMMARY OF THE INVENTION

It is, therefore, the primary objective of the present invention to provide an apparatus with an animated arm enabling one person to do an arm-wrestling exercise.

The foregoing primary objective of the present invention is attained by an apparatus having an animated arm which is designed on the basis of the mechanics of the human body and is therefore capable of compressing and relaxing like the muscle. The apparatus is fastened to the edge of a desk so as to allow a person's right hand or left hand to make contact with a point of application of the apparatus, with the person's right elbow resting on the desk top. With the persons right arm or left arm, he or she is therefore able to do the arm-wrestling exercise by himself or herself by forcing the animated arm of the apparatus down to the surface of the desk top.

The foregoing objective, features, structures and functions of the present invention will be better understood by studying the following detailed description of the invention, in conjunction with the drawings provided herewith.

DETAILED DESCRIPTION OF THE INVENTION

Figure 1:
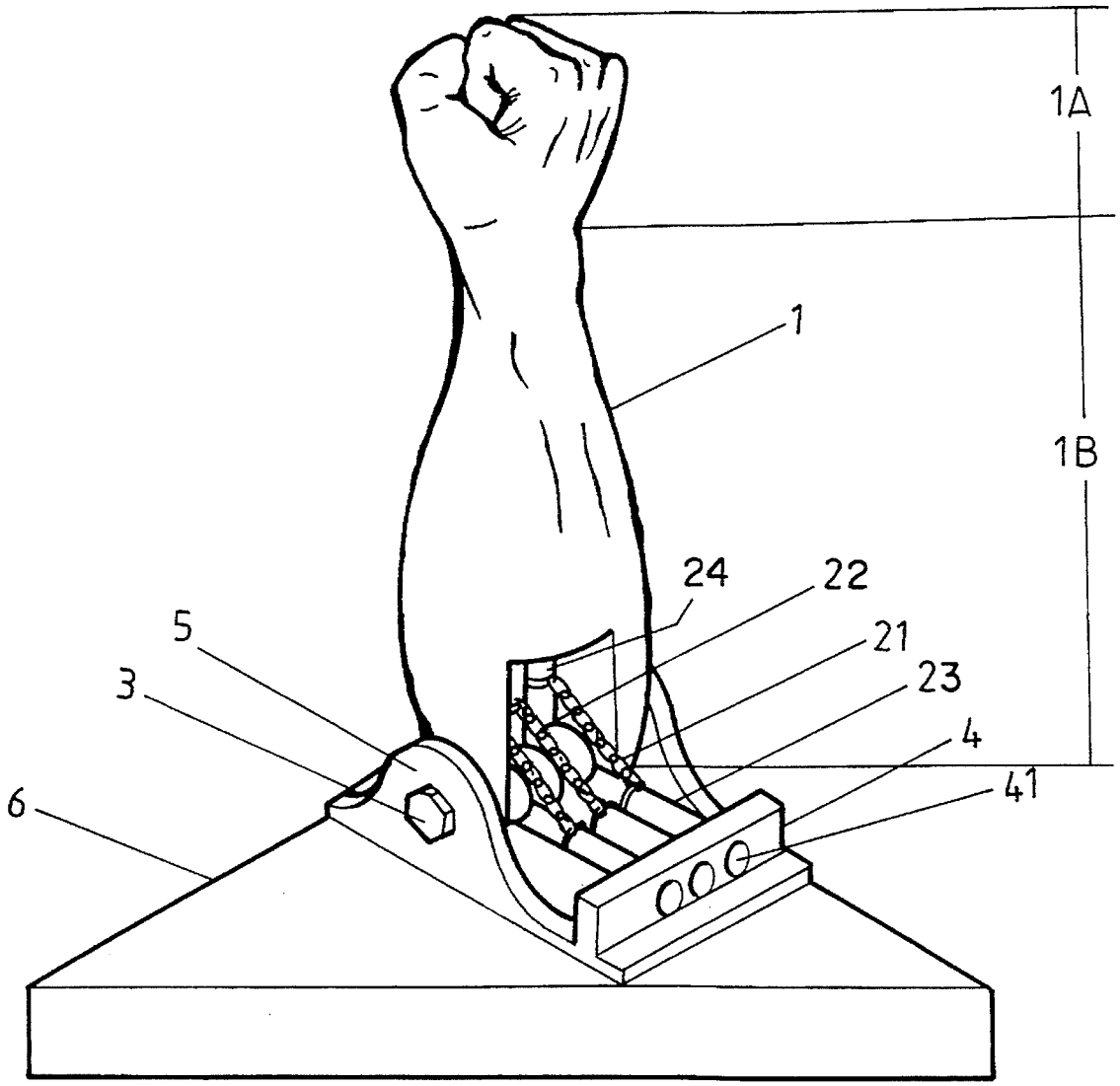
FIG.1 shows a perspective view of the present invention.
Figure 2:
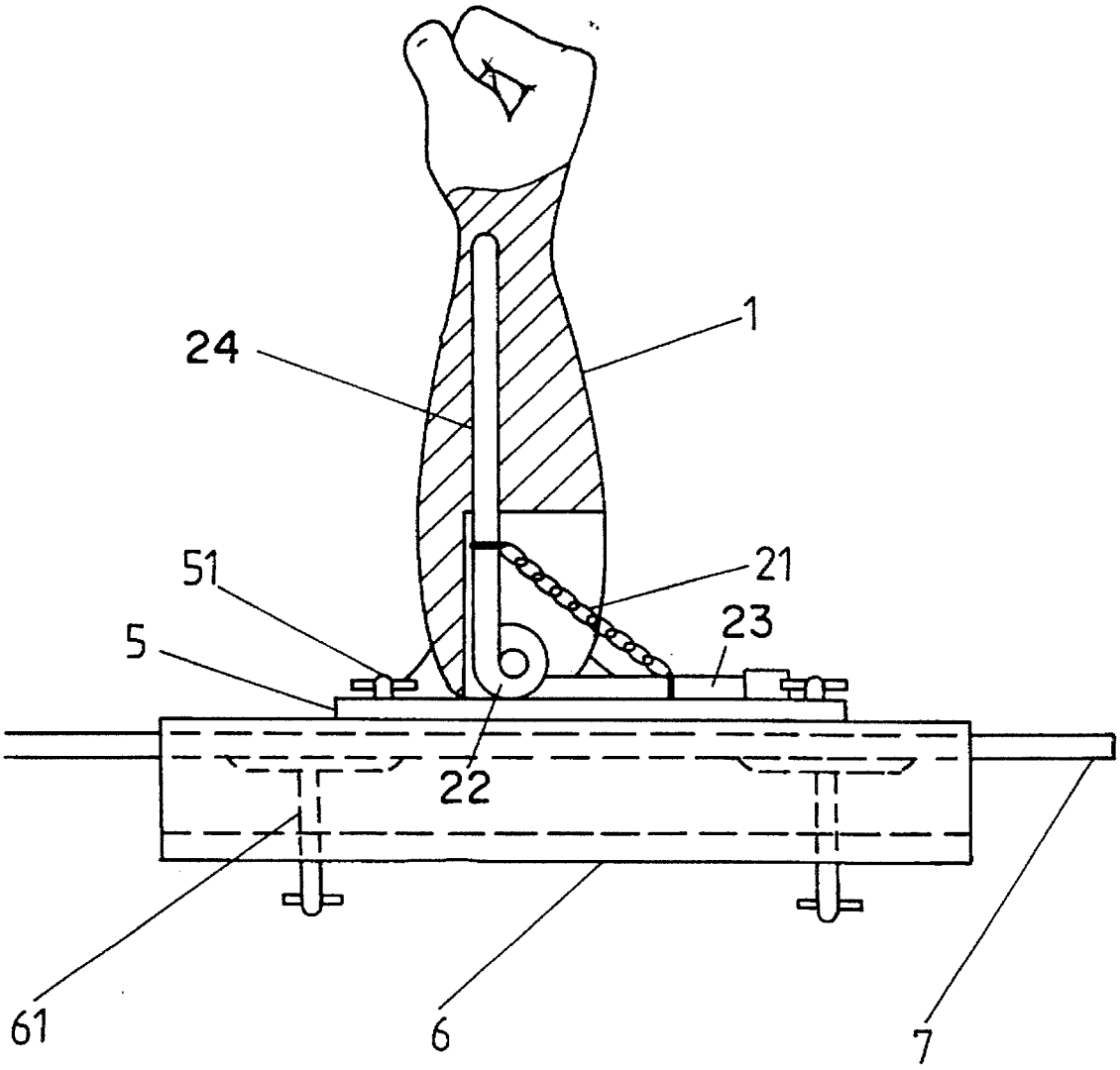
FIG.2 shows a front elevational sectional view of the present invention.

Referring to FIGS. 1 and 2, an arm-wrestling apparatus of the present invention is shown to comprise an animated arm 1 of a glass fiber material or an appropriate material.

A plurality of elastic iron bars 2 are provided in the animated arm 1. Each iron bar 2 is a torsion spring having a circular cross section 22 and two orthogonal extended portions 23, 24. The number of iron bars 2 in the animated arm 1 depends on the elastic resistance requirement desired to be presented by the animated arm 1.

Each of the iron bars 2 is arranged so that one extended portion 24 is perpendicular to, and the other extended portion 23 is parallel to, the top of a desk to which the arm-wrestling apparatus is fastened with a long screw 3. The perpendicularly extended portion 24 extends upwards into the animated arm 1. The spring 22 is located at the base of the animated arm 1 where the elbow would be in an actual arm. Thus, these features allow the arm-wrestling apparatus of the present invention to closely simulate the mechanics of the human body.

Each iron bar 2 also has a metal ligament 21 in the form of a chain positioned over spring 22 and fastened at either end onto extended portions 23, 24 in order to alleviate elastic wear in its respective iron bar 2. The ligament 21 minimizes elastic wear by preventing its respective iron bar 2, and hence the animated arm 1, from moving beyond a vertical, upright position in a direction opposite a twisting direction of the spring 22 of iron bar 2, as clearly shown in FIG. 2. As also can be seen from FIG. 2, the ligament 21 only allows the animated arm 1 to be moved downward in the twisting direction of the spring 22, thereby compressing the spring 22.

The animated arm 1 is fastened to an arm support mount 5 by means of an elongate iron plate 4 and a screw 41. The arm support mount 5 is in turn fastened securely to a triangular seat 6 by means of three small quick screws 51. The triangular seat 6 is then fastened securely to a desk top 7 by means of two large quick screws 61.

Figure 3:
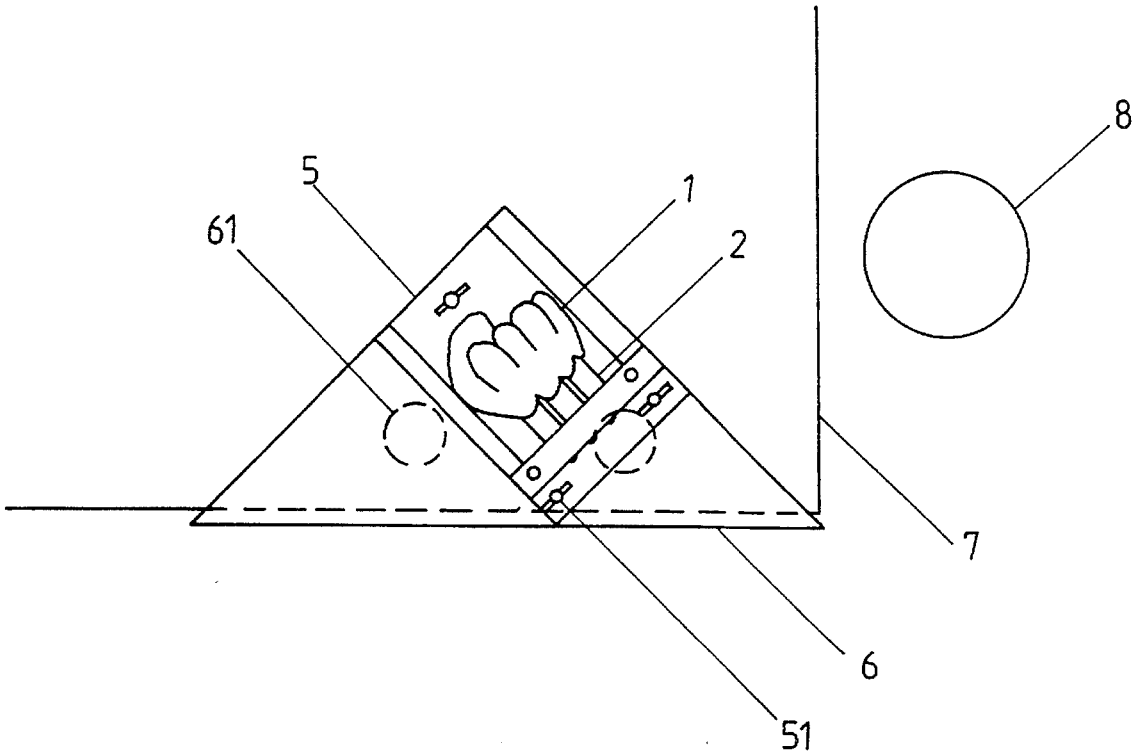
FIG.3 shows a top view of a right animated arm of the present invention at work.

As shown in FIG. 3 the right arm of a user, who is sitting on a chair 8 and is facing the desk top 7, grasps the point of application of the animated arm 1 and forces the animated arm gradually down to the desk top 7. The animated arm 1 is capable of being forced downwards by the user's right arm, in view of the fact that the animated arm 1 comprises therein the iron bars 2 provided with an appropriate elasticity. As the user allows his or her right arm to relax, the animated arm 1 is then permitted to move upwards along the path through which the animated arm 1 was previously forced down. By doing so repeatedly, the user is able to do the arm-wrestling exercise all by himself or herself.

Figure 4:
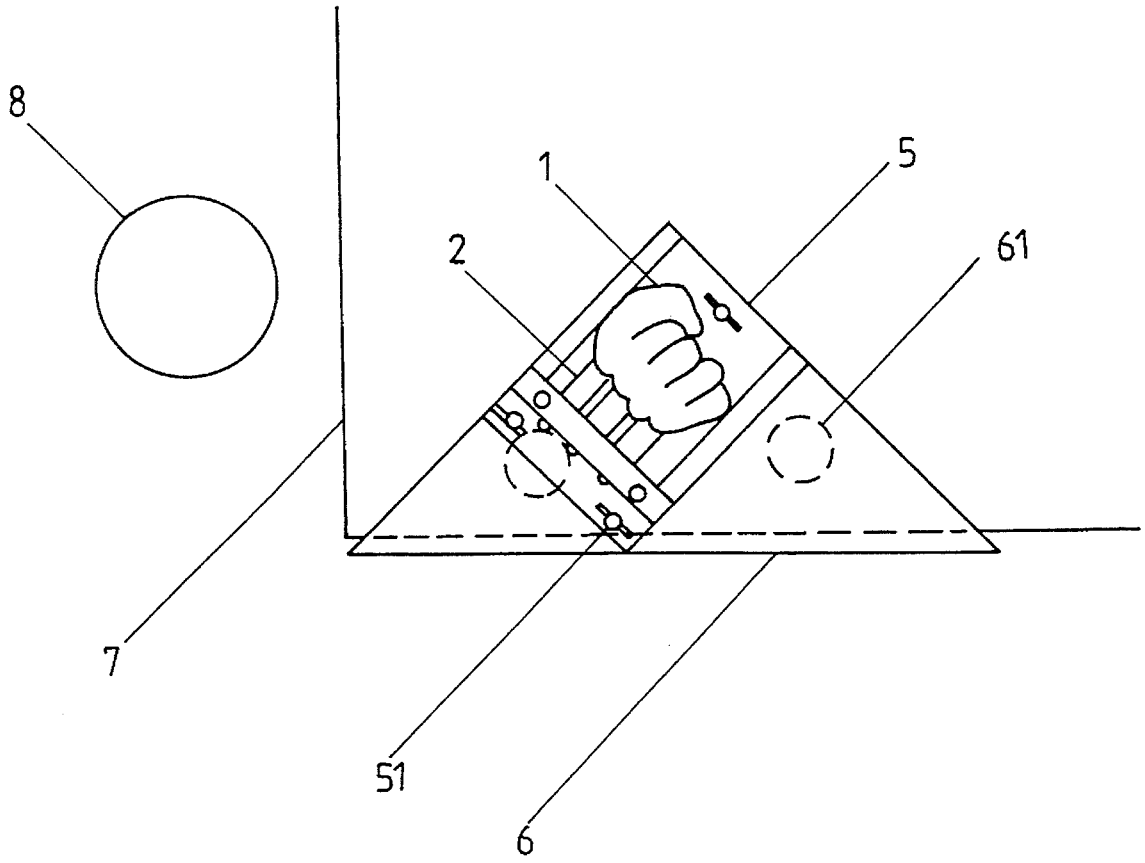
FIG.4 shows a top view of a left animated arm at work, according to the present invention.

As illustrated in FIG. 4, by switching the direction of the animated arm 1 appropriately, the user is capable of doing the arm-wrestling exercise with his or her left hand by following the directions described above.

The apparatus of the present invention is characterized in that it enables its user to do the arm-wrestling exercise alone, and that it can be fastened to any desk top at any time and at any place so that any person can do the exercise of arm-wrestling, and further that it is rather simple in construction and is easy to use for building the muscles of both left arm and right arm.

The embodiment of the present invention described above is to be regarded in all respects as merely illustrative and not restrictive, Accordingly, the present invention may be embodied in other specific forms without deviating from the spirit thereof. The present invention is therefore to be limited only by the scope of the hereinafter appended claim.

What is claimed is:

1. An apparatus enabling a person to perform arm wrestling exercises without a human opponent, comprising:

an arm support mount;

an animated arm, fastened to said arm support mount;

resistance means for resisting pivoting movement of the animated arm during the performance of arm wrestling exercises, said resistance means comprising springs each having a first extended portion extending upwards into said animated arm and a second extended portion orthogonal to said first extended portion, said springs being at least partially positioned in said animated arm such that centers of said springs are located at a base of said animated arm, resistance to a force exerted by the person on said animated arm being adjusted by altering a number of springs at least partially positioned in said animated arm, and said animated arm may only be moved downward in the twisting direction of the springs; and said arm support mount being fastenable to a surface upon which arm wrestling exercises are to be performed by the person.

2. The apparatus as recited in claim 1, including a triangular seat for fastening said arm support mount to said surface.

3. The apparatus as recited in claim 3, wherein said triangular seat comprises a right triangle.

4. The apparatus as recited in claim 3, a corner of said arm support mount being flush with the right angle of said right triangle.

5. An apparatus enabling a person to perform arm wrestling exercises without a human opponent, comprising:

an arm support mount;

an animated arm, fastened to said arm support mount;

resistance means for resisting pivoting movement of the animated arm during the performance of arm wrestling exercises, said resistance means comprising springs each having a first extended portion and a second extended portion orthogonal to said first extended portion, said springs being at least partially positioned in said animated arm, resistance to a force exerted by the person on said animated arm being adjusted by altering a number of springs at least partially positioned in said animated arm, and said animated arm may only be moved downward in the twisting direction of the springs;

a metal elastic ligament, a first end of said ligament being attached to said first extended portion of said spring and a second end of said ligament being attached to said second extended portion of said springs; and said arm support mount being fastenable to a surface upon which arm wrestling exercises are to be performed by the person.

6. The apparatus as recited in claim 5, wherein said ligament prevents said animated arm from moving beyond a vertical, upright position in a direction opposite the twisting direction of the springs.

* * * * *